US007579128B2

(12) United States Patent
McDougall et al.

(10) Patent No.: US 7,579,128 B2
(45) Date of Patent: Aug. 25, 2009

(54) TONER COMPOSITIONS INCLUDING STYRENE CONTAINING EXTERNAL ADDITIVES

(75) Inventors: Maria N. V. McDougall, Burlington (CA); Daryl Vanbesien, Burlington (CA); Allan K. Chen, Oakville (CA); Richard P. N. Veregin, Mississauga (CA); Vladislav Skorokhod, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/137,335

(22) Filed: Jun. 11, 2008

(65) Prior Publication Data

US 2008/0241724 A1 Oct. 2, 2008

Related U.S. Application Data

(62) Division of application No. 11/139,702, filed on May 31, 2005, now abandoned.

(51) Int. Cl.
*G03G 9/08* (2006.01)

(52) U.S. Cl. ..... 430/108.1; 430/108.4

(58) Field of Classification Search ..... 430/108.1, 430/108.4
See application file for complete search history.

(56) References Cited

U.S. PATENT DOCUMENTS

| | | | | |
|---|---|---|---|---|
| 3,590,000 | A | 6/1971 | Palermiti et al. | |
| 3,847,604 | A | 11/1974 | Hagenbach et al. | |
| 4,122,024 | A | 10/1978 | Jones et al. | |
| 4,298,672 | A | 11/1981 | Lu | |
| 4,338,390 | A | 7/1982 | Lu | |
| 4,883,736 | A | 11/1989 | Hoffend et al. | |
| 4,904,762 | A | 2/1990 | Chang et al. | |
| 4,954,408 | A | 9/1990 | Georges | |
| 4,971,882 | A | 11/1990 | Jugle | |
| 5,445,910 | A | 8/1995 | Ishikawa et al. | |
| 5,716,752 | A | 2/1998 | Ott et al. | |
| 5,747,215 | A * | 5/1998 | Ong et al. | 430/137.14 |
| 5,763,132 | A | 6/1998 | Ott et al. | |
| 5,914,209 | A | 6/1999 | Grushkin | |
| 6,358,657 | B1 | 3/2002 | Silence et al. | |
| 6,610,452 | B2 | 8/2003 | Combes et al. | |
| 2004/0137352 | A1 | 7/2004 | McStravick et al. | |
| 2004/0185361 | A1 | 9/2004 | Yoshino et al. | |

* cited by examiner

*Primary Examiner*—Hoa V Le
(74) *Attorney, Agent, or Firm*—Oliff & Berridge, PLC

(57) ABSTRACT

Toner compositions of toner particles including additive particles upon an external surface of the toner particles, wherein the additive particles include crosslinked styrene containing polymer particles, exhibit reduced sensitivity to relative humidity. The crosslinked styrene containing polymer particles have an average particle size of from about 30 nm to about 300 nm, and may include styrene homopolymer particles, styrene copolymer particles or mixtures thereof. A process of reducing the relative humidity sensitivity of toner using such external surface additive is also described.

15 Claims, No Drawings

TONER COMPOSITIONS INCLUDING STYRENE CONTAINING EXTERNAL ADDITIVES

CROSS-REFERENCE TO RELATED APPLICATIONS

The present application is a divisional application of application Ser. No. 11/139,702 filed May 31, 2005. The disclosure of the prior application is hereby incorporated by reference in its entirety.

BACKGROUND

Described herein are toner and developer compositions that include additives comprised of styrene homopolymer or copolymers, among other conventionally sized external additives, on external surfaces of the toner particles.

U.S. Pat. No. 5,763,132, incorporated herein by reference in its entirety, describes a process for decreasing toner adhesion and decreasing toner cohesion. The process comprises adding a hard spacer component of a polymer of polymethyl methacrylate (PMMA), a metal, a metal oxide, a metal carbide, or a metal nitride, to the surface of a toner comprised of resin, wax, compatibilizer, and colorant excluding black. The toner surface additives are blended with the toner, and the hard spacer component is permanently attached to the toner surface by injection in a fluid bed milling device during the size reduction process of the toner. See the Abstract and column 1, lines 9-28.

U.S. Pat. No. 5,716,752, incorporated herein by reference in its entirety, also describes a process for decreasing toner adhesion and decreasing toner cohesion. The process comprises adding a component of magnetite, a metal, a metal oxide, a metal carbide, or a metal nitride to the surface of a toner comprised of resin, wax, and colorant by blending. The component is permanently attached to the toner surface by injection in a fluid bed milling device during the size reduction process of the toner. See the Abstract.

U.S. Publication No. 2004/0137352, incorporated herein by reference in its entirety, describes a toner composition including toner particles having at least one spacer of latex particles or polymer particles attached to the toner particles, in which the latex or polymer particles have an average particle size of from about 60 nm to about 500 nm. The spacer includes latex particles of rubber, acrylic, polyacrylic, fluoride or polyester latexes and/or polymer particles of polymethyl methacrylate, polyvinylidene fluoride, melamine or polytetrafluoroethylene.

Toner particles including larger size silica particles, for example sol-gel silica particles having a size of from about 100 to about 150 nm, on external surfaces thereof have also been used. Sol-gel silicas are silicas synthesized by the controlled hydrolysis and condensation of tetraethoxysilane. The sol-gel process is typically carried out in alcohol solvents with added homopolymer solutes to control the structure of the precipitated silicon dioxide product. Examples of alcohol solvents used in the sol-gel process include methanol, ethanol and butanol. Such silica particles achieve toner charge stability and reduce impaction into the toner particles of smaller sized metal oxide surface additives such as silica and titania. See, for example, U.S. Pat. No. 6,610,452, incorporated herein by reference in its entirety. While these sol-gel silicas perform adequately, including in terms of relative humidity (RH) sensitivity, they are relatively expensive.

What is still desired is a less expensive external additive alternative to sol-gel silicas, and preferably offering the same or improved performance as sol-gel silica external additives.

SUMMARY

In embodiments, described are toner compositions comprising toner particles including additive particles upon an external surface of the toner particles, wherein the additive particles include crosslinked styrene containing polymer particles.

The styrene containing polymer particles have an average particle size of from about 30 nm to about 300 nm, and may comprise styrene homopolymer particles, styrene copolymer particles or mixtures thereof.

In further embodiments, described are developer compositions comprising the toner composition and carrier particles.

In still further embodiments, described is a process of decreasing toner relative humidity sensitivity, comprising forming toner particles and attaching additive particles to an external surface of the toner particles, wherein the additive particles include styrene containing polymer particles.

DETAILED DESCRIPTION OF EMBODIMENTS

In a first embodiment, described are toner compositions comprising toner particles including additive particles upon an external surface of the toner particles, wherein the additive particles include styrene containing polymer particles.

The crosslinked styrene containing particles may have an average particle size of from, for example, about 30 nm to about 300 nm, preferably from about 50 nm to about 150 nm, from about 75 nm to about 300 nm, from about 75 nm to about 150 nm, and most preferably from about 100 to about 150 nm. The average particle size may be measured by, for example, a Nicomp Submicron Particle Sizer.

The styrene containing particles may be comprised of styrene homopolymer, styrene copolymers or mixtures thereof.

As the styrene copolymer, any suitable comonomer materials may be used with styrene monomer to form the copolymer, such as a monomer selected from the group consisting of alkyl acrylate, 1,3-diene, alkyl methacrylate, alkyl acrylate-acrylic acid, 1,3-diene-acrylic acid, alkyl methacrylate-acrylic acid, alkyl methacrylate-alkyl acrylate, alkyl methacrylate-aryl acrylate, aryl methacrylate-alkyl acrylate, alkyl methacrylate-acrylic acid, alkyl acrylate-acrylonitrile-acrylic acid, 1,3-diene-acrylonitrile-acrylic acid, and alkyl acrylate-acrylonitrile-acrylic acid. Preferably, the comonomer is selected from among acrylates, methacrylates and mixtures thereof. In a preferred embodiment, the copolymer is comprised of styrene monomer and butyl acrylate, e.g., n-butyl acrylate, monomer, and preferably also containing an amount of β carboxyethyl acrylate.

The styrene containing polymer particles are crosslinked. This may be done by including one or more crosslinking monomers. Crosslinking monomers may include, for example, divinylbenzene or diethylene glycol methacrylate. The crosslinking monomer(s) may be included in effective amounts, for example from about 1 to about 20 percent by weight of the polymer resin. A crosslinked resin thus refers, for example, to a crosslinked resin or gel comprising, for example, about 0.3 to about 20 percent crosslinking.

If a styrene copolymer is used, the styrene monomer preferably comprises at least 50% by weight of the monomer units used to make the copolymer. More preferably, the styrene monomer preferably comprises at least 60% by weight of the monomer units of the copolymer. As the amount of styrene units in the copolymer increases, the relative humidity sensitivity of the toner particles decreases.

In a most preferred embodiment, the additive particles are comprised of styrene (A), 55% grade divinylbenzene (B), β carboxyethyl acrylate (β CEA) in the ratio of 99:1 and 3 pph of said monomers A and B. Such particles have been found to exhibit the greatest ability to reduce the relative humidity sensitivity of the toner particles.

The styrene containing polymer particles are preferably added to the toner particles in an amount of from, for example, about 0.1 to about 15% by weight of the toner composition.

The styrene containing polymer external additive particles are believed to function not only to reduce the relative humidity sensitivity of the toner particles, but also to reduce toner cohesion, stabilize the toner transfer efficiency and reduce/minimize development falloff characteristics associated with toner aging such as, for example, triboelectric charging characteristics and charge through. The toner thus avoids $A_t$ instability in a device. $A_t$ is generally defined as (q/m of toner) X (toner concentration of developer+an offset value associated with the device). These values can be derived by well known techniques in the art. See, for example, R. J. Nash and J. T. Bickmore, 4th Intl. Cong. On Adv. In Non-Impact Printing Tech., R. J. Nash, ed., IS&T, Springfield, Va., pp. 13-26 (1988); E. J. Gutman and G. C. Hartmann, J. Imaging Sci. & Tech. 36, 4, 335 (1992). $A_t$ should remain stable over the life of the developer so that the images obtained from the developer over its life remain consistent (i.e., have consistently high quality). Also, when charge drops during printing, additional toner is dispensed to developer housing. $A_t$ stability is thus required to prevent excessive amounts of toner being dispensed, which can cause print defects and dirt in non-imaged areas. The styrene containing polymer external additives described herein achieve $A_t$ stability.

The styrene containing polymer external additive particles have a larger average particle size compared to other conventional external surface additives such as metal oxides (silica or titania) or zinc stearate. The crosslinked styrene containing polymer particles may also act to reduce the impaction of smaller conventional toner external surface additives having a size of from, for example, about 8 to about 40 nm, during aging in the development housing. The styrene containing polymer particles thus stabilize the developer against disadvantageous burial of conventional smaller sized toner external additives into the toner particles during the imaging process in the development system.

Toner cohesion refers to toner particles adhering to each other. This disadvantage is avoided or minimized with the toners having the styrene containing external additive particles on the external surface.

The toner compositions thus exhibit an improved ability to maintain their DMA (developed mass per area on a photoreceptor), their TMA (transferred mass per area from a photoreceptor) and acceptable triboelectric charging characteristics and admix performance for an extended number of imaging cycles.

The toner and developer compositions can be selected for electrophotographic, especially xerographic, imaging and printing processes, including digital processes. The toners may be used in image development systems employing an aggressive developer housing that has a tendency to beat conventional smaller sized external surface additives into the surface of the toner particles, thereby causing the toner properties to degrade upon aging. Of course, the toner may be used in an image development system employing any type of development scheme without limitation, including, for example, conductive magnetic brush development (CMB), which uses a conductive carrier, insulative magnetic brush development (IMB), which uses an insulated carrier, semiconductive magnetic brush development (SCMB), which uses a semiconductive carrier, etc. The electrophotographic image forming apparatus will include at least a photoreceptor, a development system (e.g., for forming an image upon an image receiving substrate using toner), and a housing in association with the development system for containing the toner. The toner is delivered from the housing to the development system for use thereby in forming the image on the image receiving substrate. Such apparatuses are well known in the art.

The styrene containing polymer particles may be made by any suitable process, including chemical processes in which the particles are built up in a chemical reaction and physical processes in which formed larger particles are reduced in size via physical size reduction processes. Preferably, the particles are latex particles. Suitable polymerization methods may include, for example, emulsion polymerization, suspension polymerization and dispersion polymerization, each of which is well known to those versed in the art. Depending on the preparation method, the latex particles may have a very narrow size distribution or a broad size distribution. In the latter case, the latex particles prepared may be classified so that the latex particles obtained have the appropriate size to act as discussed above.

The toner particles may be comprised at least a toner binder resin and a colorant.

Illustrative examples of suitable toner resins, especially thermoplastic resins, selected for the toner compositions include polyamides, polyolefins, styrene acrylates, styrene methacrylates, styrene butadienes, polyesters, especially reactive extruded polyesters, crosslinked styrene polymers, epoxies, polyurethanes, vinyl resins, including homopolymers or copolymers of two or more vinyl monomers, and polymeric esterification products of a dicarboxylic acid and a diol comprising a diphenol. Vinyl monomers may include, for example, styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters such as esters of monocarboxylic acids including, for example, methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like; and styrene/butadiene copolymers with a styrene content of from about 70 to about 95 weight percent. In addition, crosslinked resins, including polymers, copolymers, or homopolymers of the aforementioned styrene polymers may be selected.

As the toner resin, mention may also be made of esterification products of a dicarboxylic acid and a diol comprising a diphenol. Such resins are illustrated in, for example, U.S. Pat. No. 3,590,000, the disclosure of which is totally incorporated herein by reference. Other specific toner resins include styrene/methacrylate copolymers, and styrene/butadiene copolymers; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, and extruded polyesters, especially those with a gel (cross-linked resin) amount (see, for example, U.S. Pat. No. 6,358,657, incorporated herein by reference in its entirety).

Also, waxes with a molecular weight of from about 1,000 to about 10,000, such as polyethylene, polypropylene, and paraffin waxes, may be included in, or on, the toner compositions as fuser roll release agents. Preferred waxes include polypropylenes and polyethylenes commercially available from Allied Chemical and Petrolite Corporation (e.g., POLYWAX waxes), EPOLENE N-15 commercially available from Eastman Chemical Products, Inc., and VISCOL 550-P, a low weight average molecular weight polypropylene available from Sanyo Kasei K.K., and similar materials. The commercially available polyethylenes have a molecular weight of from about 1,000 to about 1,500, while the commercially available polypropylenes that may be utilized for the toner compositions are believed to have a molecular weight of from about 4,000 to about 7,000.

The low molecular weight wax materials may be present in the toner composition in various amounts, however, generally these waxes are present in the toner composition in an amount of from about 1 percent by weight to about 15 percent by weight, and preferably in an amount of from about 2 percent by weight to about 10 percent by weight.

Other conventional toner additives may be included in the toner particles without limitation, for example, charge enhancing additives, etc.

The resin may comprise, for example, from about 50 to about 98 weight percent of the toner particles.

The colorant may be any suitable colorant including, for example, a dye, pigment, etc. The colorant is preferably present in an amount of from, for example, about 1 to about 20 weight percent of the toner particle. The colorant may impart any suitable color to the toner particle, including, for example, black, red, blue, yellow, green, brown, orange, cyan, magenta, mixtures thereof, etc.

Numerous well known suitable colorants, such as pigments, dyes, or mixtures thereof, and the like can be selected as the colorant for the toner particles. Such colorants are conventional and well-known in the art, and thus are not detailed herein.

In one embodiment, the toner is suited for use as a MICR toner. MICR refers to magnetic image character recognition. Information involved is referred to as MICR characters, which characters appear, for example, at the bottom of personal checks as printed numbers and symbols. These checks have been printed in an ink containing magnetizable particles therein, and when the information contained on the document is to be read, the document is passed through a sorter/reader that first magnetizes the magnetizable particles, and subsequently detects a magnetic field of the symbols resulting from the magnetic retentivity of the ink. The MICR toner is comprised of binder, a magnetic powder to stabilize the quantity of remnant magnetization and a large amount of wax to stabilize the durability. Suitable magnetic particles known in the art to be used in MICR toners include cubic and acicular shapes, for example, magnetites. The wax may be any of the aforementioned waxes.

A preferred emulsion aggregation MICR toner composition includes about 35 to about 45 percent by weight of bulk toner resin, about 15 to about 20 percent by weight of shell resin, about 1 to about 10 percent by weight gel (high molecular weight, crosslinked) latex resin, about 1 to about 10 percent by weight of REGAL 330 carbon black pigment, about 20 to about 30 percent by weight of magnetite and about 5 to about 10 percent by weight of POLYWAX 850 (Baker Petrolite). The particle sizes of the emulsion aggregation MICR toner preferably ranges from about 3 to about 15 microns, more preferably from about 5 to about 8 microns. The toner geometric standard distribution by volume (GSDv) is preferably about 1.25 or less.

As the resin and gel resin material for the MICR toner, a number of known toner resins can be selected such as styrene acrylates, styrene methacrylates, styrene-butadiene, polyesters (e.g., crosslinked polyester resin prepared from propoxylated bisphenol-A and fumaric acid, containing 5 to 20 weight percent gel) and the like (such as those disclosed in U.S. Pat. Nos. 4,971,882, 4,954,408, 4,904,762, 4,883,736, 4,122,024, 4,298,672, 4,338,390 and 3,590,000, the disclosures of which are fully incorporated herein by reference).

In addition, the toner particles also preferably include one or more additional external additive particles besides the styrene containing particles. Any suitable additional surface additives may be used. Most preferred are one or more of metal oxides such as, for example, silica ($SiO_2$), titania ($TiO_2$) and aluminum oxide, and a lubricating agent such as, for example, a metal salt of a fatty acid (e.g., zinc stearate (ZnSt), calcium stearate) or long chain alcohols such as UNILIN 700, as external surface additives. In general, silica is applied to the toner surface for, e.g., toner flow, tribo enhancement, admix control, improved development and transfer stability and higher toner blocking temperature. $TiO_2$ is applied for, e.g., improved relative humidity (RH) stability, tribo control and improved development and transfer stability. The additive package preferably does not include any silica sol-gel particles.

The external surface additives preferably have a primary particle size of from about 5 nm to about 40 nm, preferably about 8 nm to about 40 nm as measured by, for instance, scanning electron microscopy (SEM) or calculated (assuming spherical particles) from a measurement of the gas absorption, or BET, surface area.

The most preferred $SiO_2$ and $TiO_2$ external additives have been surface treated with compounds including DTMS (decyltrimethoxysilane) or HMDS (hexamethyldisilazane). Examples of these additives are DTMS silica, obtained from Cabot Corporation, comprised of a fumed silica, for example silicon dioxide core L90 coated with DTMS; a silica, obtained from Wacker Chemie, coated with an amino functionalized organopolysiloxane; a titania, obtained from Tayca Corporation, comprised of a crystalline titanium dioxide core coated with DTMS. The titania may also be untreated, for example P-25 from Nippon Aerosil Co., Ltd.

Zinc stearate is preferably also used as an external additive for the toners, the zinc stearate providing lubricating properties. Zinc stearate provides, for example, developer conductivity and tribo enhancement, both due to its lubricating nature. In addition, zinc stearate enables higher toner charge and charge stability by increasing the number of contacts between toner and carrier particles. Calcium stearate and magnesium stearate provide similar functions. A commercially available zinc stearate known as ZINC STEARATE L, obtained from Ferro Corporation, which has an average particle diameter of about 9 microns as measured in a Coulter counter, may be suitably used.

Each of the additional external additives present may be present in an amount of from, for example, about 0.1 to about 8 percent by weight of the toner composition. Preferably, the toners contain from, for example, about 0.1 to 5 weight percent titania, about 0.1 to 8 weight percent silica and about 0.1 to 4 weight percent zinc stearate. More preferably, the toners contain from, for example, about 0.1 to 3 weight percent titania, about 0.1 to 6 weight percent silica and about 0.1 to 3 weight percent zinc stearate.

The additives discussed above are chosen to enable superior toner flow properties, as well as high toner charge and charge stability. The surface treatments on the $SiO_2$ and $TiO_2$, as well as the relative amounts of the two additives, can be manipulated to provide a range of toner charge.

For further enhancing the charging characteristics of the developer compositions described herein, and as optional components there can be incorporated into the toner or on its surface negative charge enhancing additives inclusive of aluminum complexes, like BONTRON E-88, and the like and other similar known charge enhancing additives. Also, positive charge enhancing additives may also be selected, such as alkyl pyridinium halides, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium sulfate; bisulfates, and the like. These additives may be incorporated into the toner in an amount of from about 0.1 percent by weight to about 20 percent by weight, and preferably from 1 to about 3 percent by weight.

While any desired toner particle size may be used, in a preferred embodiment, the finished toner particles have an average particle size (volume median diameter) of from about 1.0 to about 9.0 microns, most preferably of from about 3.0 to about 8.0 microns, as measured by the well known Layson cell technique.

The toner particles may be made by any suitable process in the art. Here again, both chemical and physical processes may be mentioned as being suitable for forming the toner particles.

The external additives are preferably incorporated onto (i.e., attached to) the toner particles subsequent to formation. Any attachment procedure may be used without limitation. In a most preferred embodiment, the attachment is accomplished in, for example, a mill blender or Henschel blender. The blending may be conducted in one or more steps, that is, any of the external additives may be associated with the toner particle's external surface in blending steps separate from any of the other external additives. Heat may be applied during the blending step(s), but should be kept below the melting point of the components of the toner so as not to destroy the toner particles during incorporation of the external additives. After blending, toners may be screened to remove any loose additive agglomerates and/or toner grits formed during additive blending.

Once the toner particles with external additives thereon are formed, developer compositions may then be formed employing the toner particles. For the formulation of developer compositions, there are mixed with the toner particles carrier components, particularly those that are capable of triboelectrically assuming an opposite polarity to that of the toner composition. For example, the carrier particles may be selected to be of a positive polarity enabling the toner particles, which are negatively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in, for example, U.S. Pat. No. 3,847,604. The selected carrier particles can be used with or without a coating of any desired and/or suitable type. The carrier particles may also include in the coating, which coating can be present in one embodiment in an amount of from about 0.1 to about 5 weight percent, conductive substances such as carbon black in an amount of from about 5 to about 30 percent by weight and/or insulative substances such as melamine in an amount from about 5 to about 15 percent by weight. Polymer coatings not in close proximity in the triboelectric series may be selected as the coating, including, for example, KYNAR® and polymethylmethacrylate mixtures. Coating weights can vary as indicated herein; generally, however, from about 0.3 to about 2, and preferably from about 0.5 to about 1.5 weight percent coating weight is selected.

The diameter of the carrier particles, preferably spherical in shape, is generally from about 35 microns to about 500, and preferably from about 35 to about 75 microns, thereby permitting them to possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier.

The various embodiments will now be further illustrated with reference to the following examples.

EXAMPLE 1

A latex emulsion comprised of polymer gel particles generated from the semi-continuous emulsion polymerization of styrene, n-butyl acrylate, divinylbenzene, and β-CEA (2-carboxyethyl acrylate) was prepared as follows. A surfactant solution of 6.0 grams NEOGEN RK (anionic emulsifier) and 500 grams deionized water was prepared by mixing for 10 minutes in a stainless steel holding tank. The holding tank was then purged with nitrogen for 5 minutes before transferring into the reactor. The reactor was then continuously purged with nitrogen while being stirred at 300 RPM. The reactor was heated up to 76° C. at a controlled rate and held constant. In a separate container, 4.25 grams of ammonium persulfate initiator was dissolved in 45 grams of deionized water. Also in a second separate container, the monomer emulsion was prepared in the following manner: 162.5 grams of styrene, 87.5 grams of n-butyl acrylate, 7.5 grams of β-CEA, and 2.5 grams of 55% grade divinylbenzene, 14 grams of NEOGEN RK and 270 grams of deionized water were mixed to form an emulsion. The ratio of styrene monomer to n-butyl acrylate monomer by weight was 65 percent to 35 percent. One percent of the above emulsion is then slowly fed into the reactor containing the aqueous surfactant phase at 76° C. to form seeds while being purged with nitrogen. The initiator solution is then slowly charged into the reactor and after 20 minutes the rest of the emulsion is continuously fed in using metering pumps.

Once all the monomer emulsion is charged into the main reactor, the temperature is held at 76° C. for an additional 2 hours to complete the reaction. Full cooling is then applied and the reactor temperature is reduced to 35° C. The product is collected into a holding tank after filtration through a 1 micron filter bag. After drying, a portion of the latex molecular properties were measured to be Mw=147,800, Mn=30,500 and the onset Tg was 36.8° C. The average particle size of the latex as measured by Disc Centrifuge was 48 nm and residual monomer as measured by GC as <50 ppm for styrene and <100 ppm for n-butyl acrylate.

EXAMPLE 2

A latex emulsion comprised of polymer gel particles generated from the semi-continuous emulsion polymerization of styrene, n-butyl acrylate, divinylbenzene and β-CEA was prepared as follows. A surfactant solution consisting of 6.0 grams DOWFAX 2A1 (anionic emulsifier) and 500 grams deionized water was prepared by mixing for 10 minutes in a stainless steel holding tank. The holding tank was then purged with nitrogen for 5 minutes before transferring into the reactor. The reactor was then continuously purged with nitrogen while being stirred at 300 RPM. The reactor was heated up to 76° C. at a controlled rate and held constant. In a separate container, 8.1 grams of ammonium persulfate initiator was dissolved in 45 grams of deionized water. Also in a second separate container, the monomer emulsion was prepared in the following manner: 351 grams of styrene, 189 grams of n-butyl acrylate, 16.2 grams of β-CEA, 5.4 grams of 55% grade divinylbenzene, 9.4 grams DOWFAX 2A1 and 270 grams of deionized water were mixed to form an emulsion. The ratio of styrene monomer to n-butyl acrylate monomer by weight was 65 percent to 35 percent. One percent of the above emulsion is then slowly fed into the reactor containing the aqueous surfactant phase at 76° C. to form seeds while being purged with nitrogen. The initiator solution is then slowly charged into the reactor and after 20 minutes the rest of the emulsion is continuously fed in using metering pumps. Once all the monomer emulsion is charged into the main reactor, the temperature is held at 76° C. for an additional 2 hours to complete the reaction. Full cooling is then applied and the reactor temperature is reduced to 35° C. The product is collected into a holding tank after filtration through a 1 micron filter bag. After drying, a portion of the latex the molecular properties were measured to be Mw=252,000, Mn=32,700 and the onset Tg was 43.53° C. The average particle size of the latex as measured by Disc Centrifuge was 104 nm and residual monomer as measured by GC as <50 ppm for styrene and <100 ppm for n-butyl acrylate.

EXAMPLE 3

A latex emulsion comprised of polymer gel particles generated from the semi-continuous emulsion polymerization of styrene, n-butyl acrylate, divinylbenzene and β-CEA was prepared as follows. A surfactant solution consisting of 2.0 grams DOWFAX 2A1 and 500 grams deionized water was prepared by mixing for 10 minutes in a stainless steel holding tank. The holding tank was then purged with nitrogen for 5 minutes before transferring into the reactor. The reactor was then continuously purged with nitrogen while being stirred at 300 RPM. The reactor was then heated up to 76° C. at a controlled rate and held constant. In a separate container, 8.1 grams of ammonium persulfate initiator was dissolved in 45 grams of deionized water. Also in a second separate container, the monomer emulsion was prepared in the following manner: 351 grams of styrene, 189 grams of n-butyl acrylate, 16.2 grams of β-CEA, 5.4 grams of 55% grade divinylbenzene, 9.4 grams of DOWFAX 2A1 and 270 grams of deionized water were mixed to form an emulsion. The ratio of styrene monomer to n-butyl acrylate monomer by weight was 65 percent to 35 percent. One percent of the above emulsion is then slowly fed into the reactor containing the aqueous surfactant phase at 76° C. to form seeds while being purged with nitrogen. The initiator solution is then slowly charged into the reactor and after 20 minutes the rest of the emulsion is continuously fed in using metering pumps. Once all the monomer emulsion is charged into the main reactor, the temperature is held at 76° C. for an additional 2 hours to complete the reaction. Full cooling is then applied and the reactor temperature is reduced to 35° C. The product is collected into a holding tank after filtration through a 1 micron filter bag. After drying a portion of the latex the molecular properties were measured to be Mw=117,800, Mn=33,200 and the onset Tg was 52.1° C. The average particle size of the latex as measured by Disc Centrifuge was 150 nm and residual monomer as measured by GC as <50 ppm for styrene and <100 ppm for n-butyl acrylate.

EXAMPLE 4

A latex emulsion comprised of polymer gel particles generated from the semi-continuous emulsion polymerization of styrene, divinylbenzene and β-CEA was prepared as follows. A surfactant solution consisting of 4 grams NEOGEN RK and 500 grams deionized water was prepared by mixing for 10 minutes in a stainless steel holding tank. The holding tank was then purged with nitrogen for 5 minutes before transferring into the reactor. The reactor was then continuously purged with nitrogen while being stirred at 300 RPM. The reactor was heated up to 76° C. at a controlled rate and held constant. In a separate container, 8.5 grams of ammonium persulfate initiator was dissolved in 90 grams of deionized water. Also in a second separate container, the monomer emulsion was prepared in the following manner: 542 grams of styrene, 16.2 grams of β-CEA, 5.5 grams of 55% grade divinylbenzene, 9.4 grams NEOGEN RK and 230 grams of deionized water were mixed to form an emulsion. One percent of the above emulsion is then slowly fed into the reactor containing the aqueous surfactant phase at 76° C. to form seeds while being purged with nitrogen. The initiator solution is then slowly charged into the reactor and after 20 minutes the rest of the emulsion is continuously fed in using metering pumps. Once all the monomer emulsion is charged into the main reactor, the temperature is held at 76° C. for an additional 2 hours to complete the reaction. Full cooling is then applied and the reactor temperature is reduced to 35° C. The product is collected into a holding tank after filtration through a 1 micron filter bag. After drying a portion of the latex the molecular properties were measured to be Mw=264,000, Mn=32,500 and the onset Tg was 97.1° C. The average particle size of the latex as measured by Disc Centrifuge was 104 nm and residual monomer as measured by GC as <50 ppm for styrene and <100 ppm for n-butyl acrylate.

EXAMPLE 5

In this Example, the Example 1-4 external additives were compared against a comparative external additive comprised of a commercial 120 nm silica sol-gel external additive (X24 available from Shin-Etsu Chemical Co.) in bench charging evaluations.

50 g of toner particles was blended using a Fuji Mill lab blender at 12500 RPM for 30 seconds with the external additive. Developer at 4% toner-to-carrier mass ratio was prepared using 65 microns steel carrier coated with 1 wt % coating comprised of 80 wt. % poly-methyl-methacrylate and 20 wt. % carbon black. Developers were conditioned overnight in A zone (85% relative humidity (RH), 28° C.) and C zone (15% RH, 12° C.) prior to charging. The charging procedure used a paint shaker (paint shaking toner in a closed environment with steel beads is a surrogate to non-throughput aging of toner in a machine) where developer samples were collected after 5 minutes (PS 5 min) and 60 minutes (PS 60 min) shaking. The Q/m (charge-to-mass) ratio was measured using the total blow off, and charge spectrograph traces were collected from Xerox charge spectrograph.

The results are summarized in Tables 1-3. The results in Table 1 are Q/m reported in units μC/g (micro-Coulomb per gram).

TABLE 1

| | C zone | | A zone | |
|---|---|---|---|---|
| | PS 5 min | PS 60 min | PS 5 min | PS 60 min |
| Comparative silica sol-gel | −25.5 | −22.8 | −12.8 | −9.7 |
| Ex. 1 | −27.6 | −20.2 | −17.1 | −9.9 |
| Ex. 2 | −28.7 | −21 | −16.1 | −11.4 |
| Ex. 3 | −27.4 | −18.5 | −13.6 | −8.8 |
| Ex. 4 | −27.3 | −19.8 | −18.6 | −13.5 |

TABLE 2

| | C zone: A zone ratio, 5 min | C zone: A zone ratio, 60 min |
|---|---|---|
| Comparative silica sol-gel | 1.99 | 2.35 |
| Ex. 1 | 1.61 | 2.04 |
| Ex. 2 | 1.78 | 1.84 |
| Ex. 3 | 2.01 | 2.10 |
| Ex. 4 | 1.47 | 1.46 |

TABLE 3

| Aging Rates | C zone | A zone |
|---|---|---|
| Comparative silica sol-gel | 1.10 | 1.32 |
| Ex. 1 | 1.40 | 1.73 |
| Ex. 4 | 1.40 | 1.41 |
| Ex. 3 | 1.48 | 1.55 |

The data in Tables 1-3 show that the styrene/n-butyl acrylate nanogel particles (Examples 1-3) show improvements meeting and exceeding the performance of silica sol-gel in A zone, and improve RH sensitivity before and after aging. Charging improvement is realized for nanogel particles increasing from 50 nm (Example 1) to 100 nm (Example 2) in average size. A further size increase did not show any further increments in developer charging in A zone. Styrene nanogel at 100 nm (Example 4) shows remarkable improvement on A zone charging sensitivity as well as on RH sensitivity, indicating that 100% styrene nanogel particles perform best for controlling RH sensitivity.

EXAMPLE 6

A MICR toner having a particle size of 7.7 micron is prepared as follows.

11.49 kg of deionized water (DIW) with 6.09 g of anionic surfactant NEOGEN RK is charged into a 20 gallon stainless steel reactor. Under minimum agitation (~70 rpm), the pump and homogenizer are started. First, 2.04 kg of magnetite is charged slowly in five minutes. After 15 minutes of homogenizing, 1.96 kg of black pigment dispersion, 4.92 kg of core latex, 839 g of gel latex, 1.96 kg of wax dispersion (POLYWAX 850), 52.5 g of polyaluminum chloride and 36.4 g SANISOL (Kao Corporation) solution are charged. Agitation is adjusted to account for the viscosity increase. Homogenization is then continued for another ~20 minutes. Coulter counter particle size analysis is used to determine the end of homogenization, when there is no sign of coarse particles >6 μm.

Aggregation is then conducted as follows. The reactor contents are heated to ~50° C. With samples being analyzed every 15-20 minutes, hold the reactor temperature at ~50° C. until the particle size reaches 5.9±0.1 microns. At this point, 4.92 kg of shell latex is added. Once the shell latex has been added, the reactor temperature may be raised to 51° C. to encourage further particle growth. When the median particle size (D50) reaches 6.9±0.1, a 4% NaOH solution is added until the slurry pH is at 7.5.

The aggregated toner particles are then coalesced. The reactor temperature is held around 51° C. for 15-20 minutes after the addition of NaOH is completed. The reactor is then heated to 95° C. After 60 minutes at 95° C., the pH is lowered to 6.0 by adding some dilute nitric acid. Coalescence is continued by holding at 95° C. and pH 6.0 for 8 hours.

After 8 hours coalescence at 95° C., then apply full cooling. Discharge the reactor batch once the temperature is below 35° C. The final slurry is passed through a 15 micron nylon screen to remove any coarse particles. Then, the wet toner particles are washed with DIW and dried.

Approximately 7 kg of dry emulsion aggregation MICR toner is obtained from a 20 gallon experiment. The toner particle size is about 7.7 micron, with a GSDv of about 1.29. To these particles is then externally added the crosslinked styrene containing polymer particles in an amount of about 0.1 to about 15% by weight of the toner composition.

The MICR toners with the externally added the crosslinked styrene containing polymer particles exhibit higher A zone charging, stable $A_t$ and less sensitivity to relative humidity.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A toner composition comprising toner particles including additive particles upon an external surface of the toner particles, wherein the additive particles include crosslinked styrene containing polymer particles comprising:

a styrene copolymer derived from styrene monomer and at least one additional monomer selected from the group consisting of 1,3-diene, alkyl acrylate-acrylic acid, 1,3-diene-acrylic acid, alkyl methacrylate-acrylic acid, alkyl methacrylate-alkyl acrylate, alkyl methacrylate-aryl acrylate, aryl methacrylate-alkyl acrylate, alkyl methacrylate-acrylic acid, alkyl acrylate-acrylonitrile-acrylic acid, 1,3-diene-acrylonitrile-acrylic acid, alkyl acrylate-acrylonitrile-acrylic acid and combinations thereof, or a crosslinked styrene homopolymer.

2. The toner composition according to claim 1, wherein the crosslinked styrene containing polymer particles have an average particle size of from about 30 nm to about 300 nm.

3. The toner composition according to claim 1, wherein the crosslinked styrene containing polymer particles are present in an amount of about 0.1 to about 15% by weight of the toner composition.

4. The toner composition according to claim 1, wherein the crosslinked styrene containing polymer particles comprise crosslinked styrene copolymer, wherein the styrene copolymer comprises more than 50% by weight of the copolymer of styrene monomer units.

5. The toner composition according to claim 1, wherein the crosslinked styrene containing polymer particles comprise crosslinked styrene copolymer, wherein the styrene copolymer has a crosslinking density from about 0.3 percent to about 20 percent.

6. The toner composition according to claim 1, wherein the toner particles are comprised of resin binder and a colorant.

7. The toner composition according to claim 6, wherein the toner composition further includes at least one wax.

8. The toner composition according to claim 7, wherein the toner composition further includes magnetic particles.

9. The toner composition according to claim 1, wherein the toner particles include one or more additional additive particles upon the external surface of the toner particles, wherein the one or more additional additive particles are selected from the group consisting of silica exclusive of silica sol-gel, titania and zinc stearate, and wherein the external additives have an average particle size of from about 5 nm to about 40 nm.

10. A MICR (magnetic image character recognition) toner comprising toner particles comprised of at least one binder, at least one colorant, at least one wax and magnetic particles, and further including additive particles upon an external surface of the toner particles, wherein the additive particles include crosslinked styrene containing polymer particles comprising:

a styrene copolymer derived from styrene monomer and at least one additional monomer selected from the group consisting of 1,3-diene, alkyl acrylate-acrylic acid, 1,3-diene-acrylic acid, alkyl methacrylate-acrylic acid, alkyl methacrylate-alkyl acrylate, alkyl methacrylate-aryl acrylate, aryl methacrylate-alkyl acrylate, alkyl methacrylate-acrylic acid, alkyl acrylate-acrylonitrile-acrylic acid, 1,3-diene-acrylonitrile-acrylic acid, alkyl acrylate-acrylonitrile-acrylic acid and combinations thereof, or a crosslinked styrene homopolymer.

11. The MICR toner according to claim 10, wherein the MICR toner exhibits higher A zone charging, greater $A_t$ stability and less relative humidity sensitivity compared to an identical MICR toner not including the crosslinked styrene containing polymer particles external additive.

12. A process of decreasing toner relative humidity sensitivity, comprising forming toner particles, and attaching additive particles to an external surface of the toner particles, wherein the additive particles include crosslinked styrene containing polymer particles comprising:

a styrene copolymer derived from styrene monomer and at least one additional monomer selected from the group consisting of 1,3-diene, alkyl acrylate-acrylic acid, 1,3-diene-acrylic acid, alkyl methacrylate-acrylic acid, alkyl methacrylate-alkyl acrylate, alkyl methacrylate-aryl acrylate, aryl methacrylate-alkyl acrylate, alkyl methacrylate-acrylic acid, alkyl acrylate-acrylonitrile-acrylic acid, 1,3-diene-acrylonitrile-acrylic acid, alkyl acrylate-acrylonitrile-acrylic acid and combinations thereof, or a crosslinked styrene homopolymer.

13. The process according to claim 12, wherein the attaching is achieved by blending the additive particles with the toner particles.

14. The process according to claim 12, wherein the crosslinked styrene containing polymer particles have an average particle size of from about 30 nm to about 300 nm.

15. An electrophotographic image forming apparatus comprising a photoreceptor, a development system, and a housing in association with the development system for containing the toner composition of claim 1.

* * * * *